US005209562A

United States Patent [19]

Glassford

[11] Patent Number: 5,209,562

[45] Date of Patent: May 11, 1993

[54] UTILITY LIGHT

[76] Inventor: Joseph B. Glassford, 620 N. Arbogast St., Griffith, Ind. 46319

[21] Appl. No.: 861,237

[22] Filed: Mar. 31, 1992

Related U.S. Application Data

[63] Continuation-in-part of Ser. No. 585,476, Sep. 20, 1990, Pat. No. 5,101,333.

[51] Int. Cl.[5] ..... F21V 15/00

[52] U.S. Cl. ..... 362/378; 362/294; 362/396; 362/419

[58] Field of Search ..... 362/294, 376, 378, 396, 362/398, 399, 400, 418, 419, 413, 414

[56] References Cited

U.S. PATENT DOCUMENTS

| | | | |
|---|---|---|---|
| 2,247,022 | 6/1941 | Hovorka | 362/396 |
| 2,276,499 | 3/1942 | Loeding | 362/344 |
| 2,360,420 | 10/1944 | Hill | 362/192 |
| 2,569,068 | 9/1951 | Maxwell | 362/344 |
| 2,598,310 | 5/1952 | Schaser | 362/395 |
| 2,899,540 | 8/1959 | Allmand et al. | 362/192 |
| 3,026,409 | 8/1958 | Deisch | 362/258 |
| 3,147,928 | 9/1964 | Carpenter | 362/394 |
| 3,187,170 | 6/1965 | Kille | 362/8 X |
| 3,875,396 | 4/1975 | Webb | 362/99 |
| 3,944,806 | 3/1976 | Jones et al. | 362/191 |
| 3,997,776 | 12/1976 | Ruud | 362/127 |
| 4,288,848 | 9/1981 | Fido | 362/378 |
| 4,419,658 | 12/1983 | Jarosz et al. | 340/521 |
| 4,422,136 | 12/1983 | Newman et al. | 362/376 X |
| 4,480,294 | 10/1984 | Carboni | 362/376 X |
| 4,513,359 | 4/1985 | Nielson | 362/390 X |
| 4,881,559 | 11/1989 | Kin | 132/226 |
| 4,885,670 | 12/1989 | Baake | 362/376 X |

FOREIGN PATENT DOCUMENTS

| | | |
|---|---|---|
| 165834 | 4/1950 | Austria . |
| 1547657 | 10/1968 | France . |
| 799999 | 8/1958 | United Kingdom . |

*Primary Examiner*—Stephen F. Husar
*Attorney, Agent, or Firm*—Olson & Hierl, Ltd.

[57] ABSTRACT

A utility light includes a light source subassembly, removable mounting means and an elongated flexible gooseneck portion having one end connected to the mounting means and the opposite end connected to the light source subassembly. A control switch and a power source are in electrical communication with the light source subassembly. In the light source subassembly, a light bulb mounted in a socket is shielded from impact by a protector, such as a cage or hood. A coating on the cage or hood provides shock absorption and heat dissipation.

15 Claims, 2 Drawing Sheets

UTILITY LIGHT

RELATED APPLICATION

This application is a continuation-in-part of earlier application U.S. Ser. No. 585,476 filed Sep. 20, 1990, now U.S. Pat. No. 5,101,333 issued Mar. 31, 1992.

FIELD OF THE INVENTION

The present invention relates to light fixtures and, in particular, to a shock absorbing, heat dissipating utility light which effectively directs light into constricted work areas.

BACKGROUND OF THE INVENTION

One of the essential requirements for detailed or close work is adequate lighting. Unfortunately, providing adequate lighting in a restricted workspace is often a problem. A good example is a mechanic working on an automobile. With the general trend in downsizing and the considerable number of components found on late model automobiles, the available workspace is very limited.

The amount of general lighting usually available in a garage is insufficient for close work. The shadows cast by or upon the many components in an automobile make working without directed illumination nearly impossible.

One option has been the conventional shop light which includes a light bulb surrounded on one side by a protective cage and on the other side by a reflective plate. The light bulb can be either a conventional household light bulb or a reinforced filament "rough service" light bulb. The light bulb can be clear or frosted. A hook is usually provided for hanging the light from an overhead support. The hook is either a fixed device or a swivel device attached to the reflective plate or the protective cage. The shop light hangs by the hook and is oriented by the mechanic to direct the light as needed. Unfortunately, often suitable locations for the hook are not found. An electrical power cord runs from the side opposite the hook to an electrical outlet.

Shop lights are adequate for general work, but do not provide adequate light for working in constricted areas. Moreover, these types of lights are usually too large and cumbersome to fit into constricted workspaces. As a result, light cannot be directed into the desired locations because of obstructions or the physical size of the components. In view of these limitations, mechanics often work solely by touch. In addition to being time consuming, obvious safety hazards result from such practices.

Additionally, shop lights emit light in a full half circle or more, rather than concentrating it on desired locations. This light "overspray" is very distracting to a mechanic and can cause eye irritation. The eye irritation can also lead to time consuming and dangerous working conditions.

A utility light is needed which provides direct lighting in constricted work areas. The device should be easy to use and have a durable construction. The device described herein meets these needs.

SUMMARY OF THE INVENTION

The present invention relates to a utility light device which can be mounted adjacent to a work area to provide direct lighting in a constricted workspace and which is shock absorbing and heat dissipating. The device can be mounted on a flat surface, on a cylindrical surface such as along the length of a hose, or by magnetic means to a metal surface.

The device includes a light source, means for removably mounting the light source on a surface, a flexible gooseneck portion having a first end connected to the mounting means and a second end connected to the light source, and means for controlling the light source including circuit means in electrical communication with the light source.

The mounting means securely but removably secures the device to the surface. Preferably, the mounting means is a pincer-type clamp means. The flexible gooseneck portion can be of various lengths and can be manipulated into a variety of positions and orientations. The second end of the flexible portion includes the light source which can be adjusted until the light from the light source is directed to the desired location. The flexible portion allows easy manipulation yet is rigid enough to maintain the light stationary once the light source has been positioned.

The controlling means can comprise an electrical switch that can include a three-way switch or a rheostat which is located at the mounting means, at the light source or along an electrical power source before it reaches the mounting means. This switch enables the user to operate the light from any desired location.

The light source includes a light bulb receiving electrical socket member and bulb-protective means in association therewith. However, particularly with a filament-type light bulb, protection of the light bulb from breakage caused by direct impact with an exterior object is not alone sufficient to overcome certain other major problems found to be associated with use of a utility light device where the available workspace is very limited. One of these problems results from the circumstance that even a relatively small impact against a bulb-protective means, as from a manipulated tool or an abruptly dislodged part, can be sufficient when transmitted through the socket member, to so shock a heated, illuminated light bulb as to break the filament. The bulb is then immediately extinguished, and work in progress halts until the bulb is replaced.

Another of these problems results from the circumstance that a filament type light bulb typically generates a significant amount of heat when it is illuminated. Not only can the entire region near an illuminated light bulb become uncomfortably hot for a user working there, but also the illuminated bulb can so heat the bulb protective means that any contact therewith, such as accidentally by the user's bare forearm or hand results in a skin burn.

To solve or greatly alleviate these problems, the bulb protective means is preferably provided with a dually functioning means which not only absorbs and dissipates mechanical-type impact shocks, but also dissipates and diffuses heat produced from a lighted (or illuminating) socket-associated light bulb. It is a particular feature and advantage that this invention provides a simple, effective and reliable means by associating the bulb protective means with a coating comprised of a flocking composition or a foam composition or a combination thereof.

Other and further objects, aims, purposes, features, advantages, embodiments and the like will be apparent to those skilled in the art from the present specification, associated drawings and appended claims.

BRIEF DESCRIPTION OF THE DRAWINGS

In the accompanying drawings, which form a portion of this disclosure.

DETAILED DESCRIPTION

Figure 2:
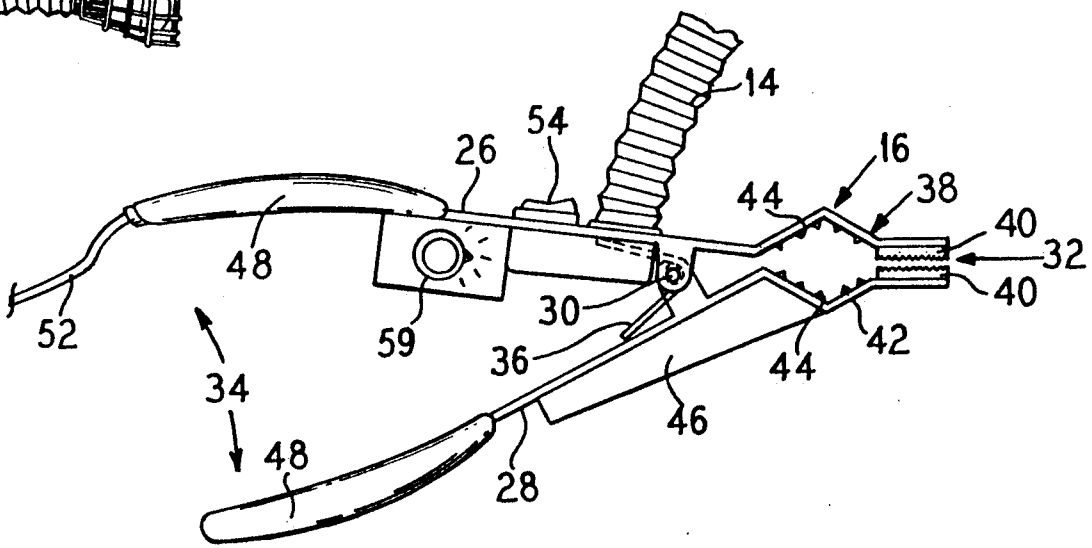
FIG. 2 is an enlarged side elevational view of the mounting means in the FIG. 1 embodiment.

The device of this invention can be assembled and used in many different forms. This detailed description and the accompanying drawings disclose forms which provide examples of preferred embodiments of the present device. The particular shapes and sizes of the components described are not essential to the invention unless otherwise indicated. Moreover, the invention is not intended to be limited to the embodiments illustrated.

For ease of reference, one embodiment 18 of a device of the invention is described in a normal operating position. It will be understood, however, that the device 18 may be used in an orientation other than the particular position described. The device 18 includes a light source subassembly 10. Operatively connected to the light source subassembly 10 is a flexible gooseneck portion 12. The gooseneck portion 12 preferably comprises a tube 14 which is an elongated, manually positionable but position retentive tubular structure formed of metal, plastic, or the like and which is preferably flexible enough to be easily positioned by hand. However, the tube 14 is also rigid enough to completely support its own weight and the weight of the light source subassembly 10 and thus remain stationary once it is adjusted to a desired position. Such conventional gooseneck portions are well-known to those skilled in the art.

The end of gooseneck portion 12 opposite the light source 10 is connected to a clamp 16. The clamp 16 is better illustrated in FIG. 2.

The clamp 16 preferably includes a first handle 26 and a second handle 28. The handles 26 and 28 include clamping ends 32 and gripping ends 34. The first handle 26 and the second handle 28 are joined at a pivot point 30 which is positioned between the ends 32 and 34. A spring 36 is mounted at the pivot point 30 and has sufficient strength to keep the clamping ends 32 together in a closed position.

The clamping ends 32 preferably include two sets of jaws 38. The first set comprises mating flat jaws 40 which are mounted on the handles 26 and 28. The flat jaws 40 cooperate to clamp the device to flat surfaces such as the hood or fender of an automobile.

The clamping ends 32 also preferably include mating open jaws 40 which are mounted on the handles 26 and 28. Open jaws 42, which can include a plurality of substantially parallel ridges or teeth 44, cooperate to clamp the device to cylindrical pieces such as hoses, pipes or axles. As another clamp embodiment, a plurality of open jaws 42 may be mounted on handles 26 and 28 to provide clamping ability to cylindrical pieces of varying diameters.

In an alternative clamp embodiment, a magnet 46 is also mounted on the second handle 28. The magnet 46 can be used for mounting the device on magnetic surfaces, such as a cast iron engine block or other various ferrous metal parts.

The gripping ends 34 preferably include matching grips 48. When the grips 48 are pushed together, the handles 26 and 28 pivot about the pivot point 30, thus separating the jaws 38 at the clamping ends 32. This allows the engagement or disengagement of the clamp 16 from various surfaces as desired. When the grips 48 are released, the tension from spring 36 forces the grips 48 apart and the jaws 38 together.

The tube 14 is preferably mounted on the first handle 26 proximate to the pivot point 30 and between the pivot point 30 and the grip 48. An on-off switch 54 is mounted on the first handle 26 between the flexible tube 14 and the grip 48. The on-off switch 54 may be any usual configuration such as toggle, push-push or snap switch. As an alternative embodiment, electrical sockets can be mounted with the on-off switch 54 to provide an extension cord capability for a mechanic. An electrical cord 52 is preferably attached to the first handle 26 at the gripping end 34. The electrical cord 52 is preferably a standard cord with a plug 55 for insertion into standard electric sockets.

The electrical cord 52 is generally in electrical communication with the on-off switch 54 and the light source subassembly 10 and extends through the tube 14. Other electrical arrangements to control the light including 3-way switches and rheostat intensity controls which are well-known in the art may also be employed.

Figure 3:
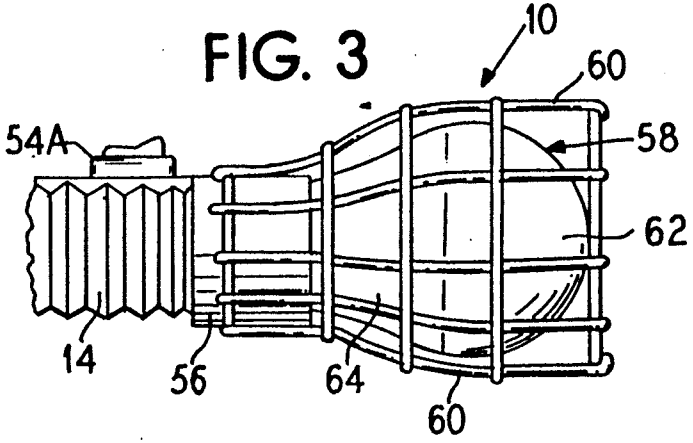
FIG. 3 is an enlarged side elevational view of the light source subassembly in the FIG. 1 embodiment.

Referring to FIG. 3, it is seen that the light source subassembly 10 incorporates an electric light bulb socket 56 that is secured to one end of the tube 14. A filament-type light bulb 58 is removably mounted within the light socket 56. Attached to the light socket 56 is a protective cage 60 which prevents damage to the light bulb 58 by accidental contact. The cage 60 is preferably made from a high impact resistent, low heat retentive plastic, a plastic-coated metal or simply an appropriate metal. Moreover, the cage 60 can comprise an open grid-like housing as illustrated, or can be open at one end only. In that event, at least some holes are preferably provided in the housing for the circulation of air.

The light bulb 58 can include a clear or preferably frosted front portion 62 and a reflective rear portion 64. Using a frosted front portion 62 produces a softer light and also eliminates shadows cast by the bulb's filament. The reflective rear portion 64 is preferably silver deposited on the interior hemisphere of the light bulb 58 which is mounted proximate to the light socket 56. The rear portion 64 thereby directs the light through the front portion 62 in a direction opposite the tube 14. This allows for direct aiming of the device and the light during use. The light bulb 58 preferably has at least about 440 lumens output.

In addition, a second switch 54A (see FIG. 3) can be included adjacent the light socket 56 to allow the light bulb 58 to be turned on and off from either the switch 54 located on the clamp 16 or the second 54A switch adjacent the light socket 56.

Figure 1:
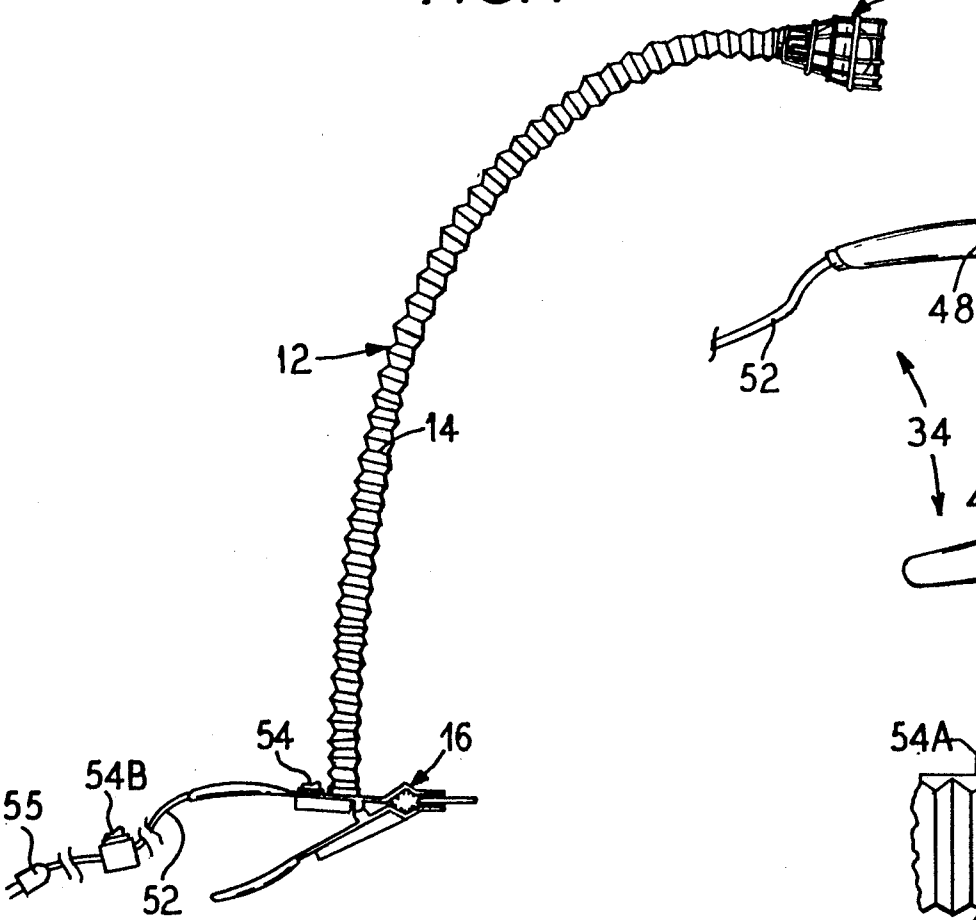
FIG. 1 is a side elevational view of one embodiment of a utility light device of this invention.

In still another embodiment, a second switch 54B (see FIG. 1) may be mounted on the electric cord 52 proximate to the electrical power source. This permits the utility light embodiment 18 to be placed into and used in very constricted areas while still permitting easy control. In the event that the mechanic's work is interrupted, the utility light device 18 may be switched on and off without any danger of disturbing its location.

Figure 4:
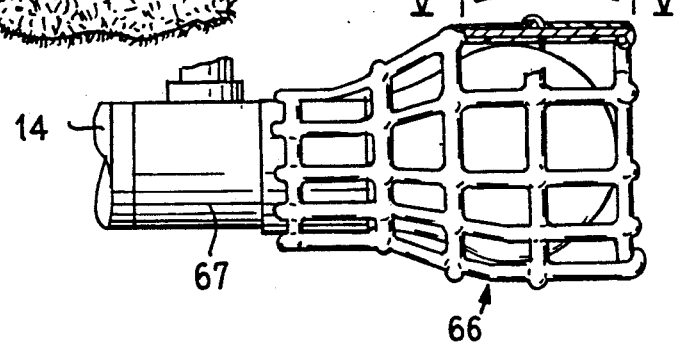
FIG. 4 is a view similar to FIG. 3 but showing an alternative embodiment of the light source in the FIG. 1 embodiment, some parts thereof being broken away and some parts thereof being shown in section.

Referring to FIG. 4, there is seen an alternative embodiment of a light source subassembly 66 which has an electric light bulb socket 67 that is operably connected to one end of the tube 14 and is electrically connected with wires (not shown) that extend through tube 14. A filament type light bulb 69 is screwed into the socket 67 through the open forward end of a cross-sectionally circular protective cage 68 within which the bulb 69 is fully received when it is fully associated with the socket 67. The cage 68 has a rear open neck region which circumferentially mounts around and against the socket 67 adjacent the light bulb 69 and is adhered thereto by an adhesive (not shown) or the like. The base of socket 67 is provided with an off-on switch 71.

Figure 5:
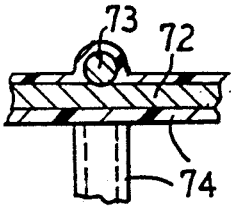
FIG. 5 is an enlarged fragmentary longitudinal sectional view taken in the region V—V of FIG. 4 showing structural details of the cage structure.

The cage 68 is comprised of a first plurality of formed longitudinally extending, circumferentially spaced wires 72 and a second plurality of formed circumferentially extending circular longitudinally spaced wires 73. Members of the first wire plurality are welded (not shown) to members of the second wire plurality at all crossover locations (see FIG. 5). The wires of the resulting structure are individually coated by dipping, painting or the like with a layer 74 of a high impact resistant, low heat retentive plastic which is preferably elastomeric and electrically insulative, such as a silicone rubber or the like. The resulting cage 68 not only prevents damage to the light bulb 69 by preventing direct impacts of the bulb 69 when an object strikes cage 68, but also prevents damage to the filament of the light bulb 69 by absorbing the shock of such an impact (or strike) from a worker's tool, from component part manipulation, or the like. Were the cage 68 not so coated, the shock of such an impact tends to be transmitted from the neck region of the cage 68 through the socket 67 and then to the bulb 69. Sufficient shock is thus transferrable to the bulb 69 filament to rupture same and thereby effectively break the light bulb 69. The so coated cage 68, however, protects bulb 68 not only against direct impact, but also, because of shock absorption, against bulb-damaging impact shocks. In addition, the layer 74 dissipates heat so that accidental skin contacts therewith do not cause burns.

Figure 6:
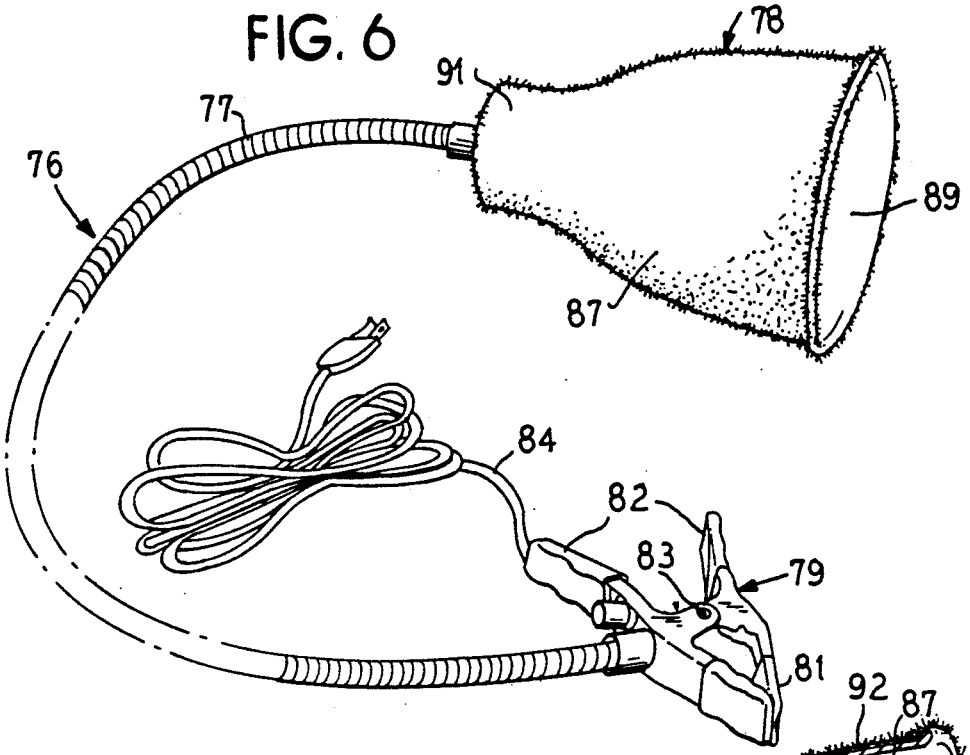
FIG. 6 is a perspective view of another embodiment of a utility light device of this invention.
Figure 7:
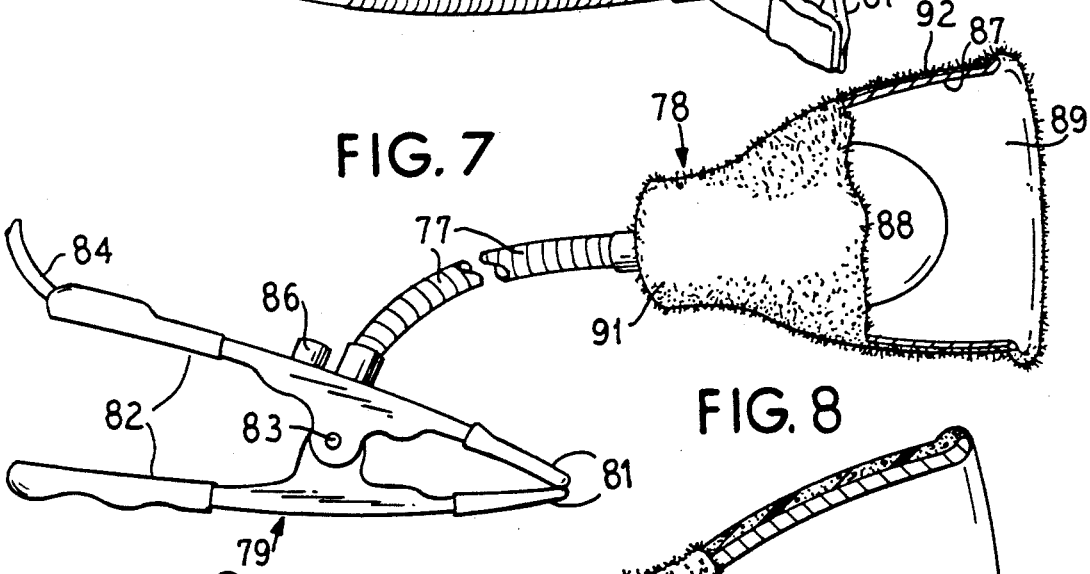
FIG. 7 is a side elevational view of the FIG. 6 embodiment showing structural details thereof, some parts thereof being broken away and some parts thereof being shown in section.

Another embodiment 76 of a device of the invention is shown in FIGS. 6 and 7. Device 76, like device 18, utilizes a flexible tube 77 which is comparable to tube 14. One end of tube 77 is operatively connected to a light source subassembly 78 while the opposite end of tube 77 is operatively connected to a clamp 79.

Clamp 79 is similar to clamp 16 except that clamp 79 is provided with a single pair of mating jaws 81 which are relatively strongly spring based into a normally closed configuration and which are opened by manual compression force exerted on the insulated handle pair 82. Such an applied force causes the jaw members 81 to open through pivoting of clamp 79 about axis 83. An electric power supply wire 84 enters one end of one handle 82 and passes through the tube 77 to inter-connect with the light source subassembly 78. One handle 82 is also provided with an off-on switch 86 that is connected to the wire 84.

An electric light bulb socket (not shown, but can be similar to either socket 56 or socket 67) in device 76 is provided with a hooded bulb protector 87 which has an open flared frontal mouth 89 that tapers to a rear neck region 91 that is circumferentially extendable about the bulb socket and is preferably secured thereto by a conventional means (such as by threads, not shown, or the like). The inside surface portions of protector 87 function as a reflector which directs light from a filament-type light bulb 88 that is mounted in the socket forwardly from the socket through mouth 89. If desired, such inside surface portions can be coated with a layer of a reflective paint or the like to enhance reflectivity. Bulb protector 87 can have various configurations, but an elongated, slender configuration (as shown) is presently preferred. Use of an opaque bulb protector, such as protector 87, is also preferred for purposes of shielding the stray light emitted from bulb 88 from the eyes of a worker using device 76. Protector 87 can be comprised of various materials, such as sheet metal, molded plastic or the like, but a present preference is to employ a protector 87 comprised of aluminum or alloy thereof because of low weight and low cost considerations. Protector 87 offers excellent protection for bulb 88 from direct impacts with solid objects. Such accidental types of impacts occur with tools, parts, or the like, and appear to occur most often from a side direction when device 76 is in use.

To provide shock absorption from impacts, and also concurrently to provide dissipation of heat on exterior surface portions of the protector 87 during use of the device 76 when the bulb 88 is on and energized, it has been found desirable to provide a layer 92 on exterior surface portions of the protector 87. This layer 92 preferably extends from the lip 93 that extends circumferentially about protector 87 to the neck region 91 thereof. The layer 92 is preferably comprised of a flocked coating composition.

The flocking coating composition can utilize a polymer such as a nylon (polyamide) a polyester (polyethylene terephthalate or the like), a urethane (polyurethane), a rayon, or the like. The flocked coating can contain various conventional fillers, including ground wood, waste cellulosic fibers (including those derived from cotton), synthetic fibers and the like. Non-flammable fillers such as fiberglass can be used in the blocked coating if desired, as can polymers with high heat resistance, such as a so-called engineering resin or the like. The flocking composition can be applied with foaming agents, if desired, thereby to entrain gas (air) bubbles or to achieve a fine open celled structure in the flocked coating layer 92. The flocked coating layer 92 can be conventionally applied to the protector 87 by spray application or the like as those skilled in the art will readily appreciate.

The thickness of a flocked coating can vary widely. A present preference is to employ a flocked coating thickness that is in the range of about 1 millimeter to about 4 millimeters, although thicker and thinner coating thicknesses can be employed if desired.

Figure 8:
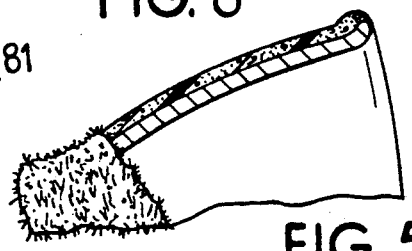
FIG. 8 is a fragmentary view of an alternative embodiment of the bulb protective hood employed in the light source subassembly of the FIGS. 6 and 7 embodiment, some part thereof being broken away and some parts thereof being shown in section.

In place of a flocked coating, the layer 92 can alternatively be comprised of a foamed plastic composition, such as one based upon a polyurethane or a polystyrene. Such a foamed plastic composition can be applied by spraying or the like as those skilled in the art will readily appreciate. The appearance of such a layer 92 is illustrated, for example, in FIG. 8. Such a foamed composition can have a thickness in the range indicated above for a flocked composition.

Figure 9:
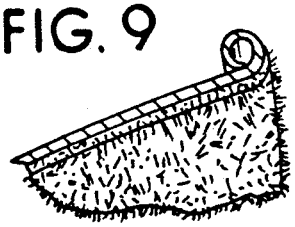
FIG. 9 is a view similar to FIG. 8 but a further alternative embodiment of the protective hood.

In place of an externally applied shock absorbing, heat dissipating flocked coating composition, one can employ, if desired, such a coating composition upon interior surface portions of a protector 87, such as illustratively shown in FIG. 9. Similar compositions and coating thicknesses can be employed comparable to those used externally as above described. Also, if desired, such a shock absorbing, heat dissipating coating can be applied to both external and internal surfaces of a protector 87.

Although it is presently preferred to employ such heat dissipating, shock absorbing coatings with continuously extending opaque protectors such as protector 87, these coatings can also be used effectively with protective cages such as a cage 60 or 68.

Such a shock absorbing, heat dissipating coating upon a protector 87 or a protective cage 60 greatly enhances the utility and safety of a device of this invention.

The foregoing illustrates the general principles of this invention. However, since numerous modifications and changes will be readily apparent to those skilled in the art based on this description, it is not desired to limit the invention to the exact construction and operation shown and described. Accordingly, the scope of this invention includes other modifications and equivalents that fall within the scope of the foregoing description and the following claims.

What is claimed is:

1. A utility light device comprising in combination:

(a) a light source subassembly comprising
 an electric socket means,
 impact resistant bulb protective means in association with said socket means, and
 coating means associated with said bulb protective means for shock absorption and heat dissipation;

(b) an elongated, manually positionable but position retentive tubular means with opposing ends, one said end being functionally connected to said socket means;

(c) removable mounting means for holding said device, the other of said ends being functionally connected thereto; and (d) electric wire means connected to said socket means and extending therefrom through said tubular means and out from said mounting means, and including on-off switch

2. The device of claim 1 in functional association with a filament-type light bulb.

3. The device of claim 1 wherein said coating means comprises a flocked composition.

4. The device of claim 1 wherein said coating means comprises a foamed composition.

5. The device of claim 1 wherein said coating means covers continuously at least generally exterior surface portions of said bulb protective means.

6. The device of claim 1 wherein said bulb protective means is a hood with a flared mouth.

7. A utility light for a constricted work area or the like comprising in combination:

(a) a light bulb receiving electrical socket member;

(b) a bulb protective impact resistant structure in association with said socket member including a bulb access port to said socket member and aperture means transmissive of light, said structure being generally continuously coated on at least exterior or interior surface areas thereof with a shock absorbing and heat dissipating layer;

(c) a pincer-type clamp means having two elongated arms disposed in adjacent spatial relationship to one another, each arm having a handle portion and a longitudinally adjacent jaw portion with a projecting lug portion therebetween, said arms being pivotally interconnected together by pin means extending through said respective lug portions at a cross over location therebetween so that said respective jaw portions articulate and matingly engage one another when closed, and further having spring means adjacent said pin means which yieldingly biases said jaw portions into a normally closed engagement;

(d) each one of said jaw portions having a terminal flat region and a longitudinally adjacent arcuate region so that when said jaw portions are closed said respective flat regions are in contacting relationship and said respective arcuate regions define an open channel therebetween;

(e) a flexible, elongated gooseneck member interconnected at one end thereof with a base portion of said socket member and at the opposite end thereof with a mid-outer surface portion of one of said elongated arms, including interconnection means therefor;

(f) electrical cord means functionally connected to said socket member at one end thereof, and extending from said socket member through said gooseneck member, then along said one elongated arm, and finally outwardly away from said handle portion of said one elongated arm; and (g) first electrical on-off switch means functionally associated with said cord means and mounted against said one elongated arm, including mounting means therefor.

8. The utility light of claim 7 wherein said socket member is functionally associated with a light bulb.

9. The utility light of claim 7 wherein said layer is a flocked composition.

10. The utility light of claim 7 wherein said layer is a foamed composition.

11. The utility light of claim 7 wherein said bulb protective structure is a cage.

12. The utility light of claim 7 wherein said bulb protective structure is a hood with a flared mouth.

13. The utility light of claim 7 wherein said layer has a thickness in the range of about 1 to about 4 millimeters.

14. The utility light of claim 7 wherein said hood is a configured as a reflector and wherein exterior surfaces portions thereof are so coated with said layer.

15. The utility light of claim 14 wherein said layer is comprised of a flocked composition.

* * * * *